US008556603B2

(12) United States Patent
Ree

(10) Patent No.: US 8,556,603 B2
(45) Date of Patent: Oct. 15, 2013

(54) PROGRESSING CAVITY PUMP ADAPTED FOR PUMPING OF COMPRESSIBLE FLUIDS

(75) Inventor: Sigurd Ree, Loddefjord (NO)

(73) Assignee: AGR Subsea AS, Straume (NO)

( * ) Notice: Subject to any disclaimer, the term of this patent is extended or adjusted under 35 U.S.C. 154(b) by 588 days.

(21) Appl. No.: 12/677,280

(22) PCT Filed: Sep. 9, 2008

(86) PCT No.: PCT/NO2008/000321

§ 371 (c)(1),
(2), (4) Date: Apr. 13, 2010

(87) PCT Pub. No.: WO2009/035337

PCT Pub. Date: Mar. 19, 2009

(65) Prior Publication Data

US 2010/0329913 A1 Dec. 30, 2010

(30) Foreign Application Priority Data

Sep. 11, 2007 (NO) ..... 20074591

(51) Int. Cl.

| | |
|---|---|
| ***F01C 1/10*** | (2006.01) |
| ***F01C 5/00*** | (2006.01) |
| ***F01C 21/00*** | (2006.01) |
| ***F03C 2/00*** | (2006.01) |
| ***F03C 4/00*** | (2006.01) |
| ***F04C 2/00*** | (2006.01) |
| ***F04C 5/00*** | (2006.01) |
| ***F04C 18/00*** | (2006.01) |

(52) U.S. Cl.
USPC ..... 418/48; 418/270

(58) Field of Classification Search
USPC ..... 418/150, 48
See application file for complete search history.

(56) References Cited

U.S. PATENT DOCUMENTS

| | | | |
|---|---|---|---|
| 1,892,217 | A | 12/1932 | Moineau |
| 2,483,370 | A | 9/1949 | Moineau |
| 2,553,548 | A | 5/1951 | Canazzi et al. |

(Continued)

FOREIGN PATENT DOCUMENTS

| | | | |
|---|---|---|---|
| DE | 3119568 | A1 | 2/1982 |
| DE | 3712270 | A1 | 10/1988 |

(Continued)

OTHER PUBLICATIONS

AIPN English Machine Translation for JP H05-087059.*

(Continued)

*Primary Examiner* — Kenneth Bomberg
*Assistant Examiner* — Deming Wan
(74) *Attorney, Agent, or Firm* — Foley & Lardner LLP

(57) ABSTRACT

A progressing cavity pump adapted for pumping of compressible fluids may include an inner rotor having a number of thread-starts together with an adapted stator or outer rotor provided with one extra thread-start. A number of closed pump cavities are formed which are moved, during fluid conveyance, from the inlet side of the pump to the outlet side of the pump, at which position they become open outlet cavities exposed to the fluid pressure in a downstream pipeline. At least one passage is disposed between the outlet side and the closed pump cavity defined closest to the outlet side. The passage is structured for intentional fluid back-flow from the outlet side in a measured and approximately constant volume.

9 Claims, 6 Drawing Sheets

(56) References Cited

U.S. PATENT DOCUMENTS

| | | | | | |
|---|---|---|---|---|---|
| 3,499,389 | A | | 3/1970 | Seeberger et al. | |
| 3,999,901 | A | | 12/1976 | Tschirky | |
| 4,080,115 | A | | 3/1978 | Sims et al. | |
| 4,482,305 | A | | 11/1984 | Nátkai et al. | |
| 4,592,427 | A | | 6/1986 | Morgan | |
| 4,676,725 | A | | 6/1987 | Eppink | |
| 5,017,087 | A | | 5/1991 | Sneddon | |
| 5,120,204 | A | * | 6/1992 | Mathewson et al. | 418/48 |
| 5,358,390 | A | * | 10/1994 | Jager | 418/48 |
| 5,407,337 | A | | 4/1995 | Appleby | |
| 5,722,820 | A | * | 3/1998 | Wild et al. | 418/48 |
| 6,063,001 | A | | 5/2000 | Suhling et al. | |
| 6,241,494 | B1 | | 6/2001 | Pafitis et al. | |
| 6,336,796 | B1 | * | 1/2002 | Cholet et al. | 418/48 |
| 6,457,958 | B1 | * | 10/2002 | Dunn | 418/1 |
| 6,461,128 | B1 | * | 10/2002 | Wood | 418/48 |
| 7,413,416 | B2 | | 8/2008 | Bartu | |
| 2001/0005486 | A1 | | 6/2001 | Wood | |
| 2003/0019682 | A1 | | 1/2003 | Schaedler et al. | |
| 2004/0057846 | A1 | | 3/2004 | Denk et al. | |
| 2005/0169779 | A1 | | 8/2005 | Bratu | |
| 2010/0239446 | A1 | | 9/2010 | Ree | |

FOREIGN PATENT DOCUMENTS

| | | | | |
|---|---|---|---|---|
| DE | 86 17 489 | U1 | | 11/1990 |
| DE | 197 15 278 | A1 | | 12/1998 |
| EP | 0255336 | A2 | | 2/1988 |
| EP | 1400693 | A3 | | 3/2004 |
| EP | 1 559 913 | A1 | | 8/2005 |
| EP | 1 418 336 | B1 | | 10/2007 |
| JP | 05087059 | A | * | 4/1993 |
| NO | 327505 | B1 | | 7/2009 |
| WO | WO 99/22141 | A2 | | 5/1999 |
| WO | WO 2009/035337 | A1 | | 3/2009 |

OTHER PUBLICATIONS

U.S. Appl. No. 13/059,425, filed Feb. 17, 2011, Ree.
U.S. Appl. No. 13/059,427, filed Feb. 17, 2011, Ree.

* cited by examiner

SECTION C-C

SECTION D-D

SECTION E-E

SECTION F-F

SECTION G-G

SECTION I-I

SECTION J-J

SECTION K-K

SECTION L-L

PROGRESSING CAVITY PUMP ADAPTED FOR PUMPING OF COMPRESSIBLE FLUIDS

SUMMARY

This invention relates to a progressing cavity pump adapted for pumping of compressible fluids. More particularly, it relates to a progressing cavity pump which is adapted for pumping of compressible fluids, wherein the progressing cavity pump has an inner rotor with a number of thread-starts, wherein the inner rotor cooperates with an adapted stator or outer rotor provided with one thread-start more than that of the inner rotor, and wherein a number of restricted pump cavities are formed which, during fluid conveyance, are moved from the inlet side of the pump to the outlet side of the pump, each cavity having a length corresponding to the pitch of the stator or the outer rotor. At least one passage is disposed between the outlet side and the at least one pump cavity defined closest to the outlet side, wherein said passage is structured for intentional fluid back-flow from the outlet side in a measured and approximately constant volume so as to allow the pressure, under the assumed operating conditions, to be approximately equalized between the outlet side and said pump cavity before the pump cavity is fully opened towards the outlet side, thereby becoming what is termed an outlet cavity in the following.

The invention relates to a progressing cavity pump, especially for pumping of compressible fluids, for example multiphase fluids consisting of oil, water and hydrocarbon gases.

Progressing cavity pumps, also termed Mono pumps, PCP pumps or Moineau pumps, are a type of displacement pumps which are commercially available in a number of designs for different applications. In particular, these pumps are popular for pumping high-viscosity fluids. Typically, such pumps include what is normally a metallic screw-shaped rotor (termed the inner rotor below) with Z number of parallel threads (termed thread-starts below), Z being any positive integer. The rotor typically extends within a cylinder-shaped stator with a core of an elastic material in which a helical cavity extending therethrough is formed with (Z+1) internal thread-starts. The pitch ratio between the stator and rotor should then be (Z+1)/Z, the pitch being defined herein as the length between adjacent thread-crests from the same thread-start.

When the geometric design of the threads of the rotor and stator is in accordance with mathematical principles written down by the mathematician Rene Joseph Louis Moineau in, for example, U.S. Pat. No. 1,892,217, the rotor and stator together will form a number of, in principle, closed cavities by virtue of having, in any section perpendicular to the centre axis of the rotor screw, at least one point of full, or approximately full, contact between the inner rotor and the stator. The central axis of the rotor will be forced by the stator into an eccentric position relative to the central axis of the stator. For the rotor to rotate about its own axis within the stator, the eccentric position of the axis of the rotor will need to be rotated at the same time about the centre axis of the stator, but in the opposite direction and at a constant centre distance. Therefore, in pumps of this type there is normally an intermediate shaft with 2 universal joints arranged between the rotor of the pump and the motor driving it.

The pumping effect is achieved by virtue of said rotational movements causing the, in principle, closed pump cavities, which are located between the inner surfaces of the stator and the outer surfaces of the rotor, to be moved from the inlet side of the pump towards the outlet side of the pump during conveyance of liquid, gas, granulates etc. Characteristically enough, in the English language these pumps have therefore often been termed "PCP" or "Progressing Cavity Pumps". This represents established terminology also within, for example, the Norwegian oil industry.

The volumetric efficiency of the pump is determined mainly by the extent to which these, in principle, restricted pump cavities have been designed so as to actually remain sealed at the particular number of revolutions, pump medium and differential pressure; or if a certain back-flow arises due to the inner walls of the stator yielding elastically, or due to the stator and rotor being fabricated with a certain clearance between the parts. In order to increase the volumetric efficiency, progressing cavity pumps with elastic stators most often are designed with an under-dimensioning in the cavity, whereby an elastic squeeze fit exists.

Although little known and hardly widespread industrially, but nevertheless described already in said U.S. Pat. No. 1,892,217, are designs of progressing cavity pumps in which a part, similar to the one termed stator above, is caused to rotate about its own axis in the same direction as the internal rotor. In this case the part with (Z+1) internal thread-starts may more correctly be termed an outer rotor. At a fixed speed ratio between the outer rotor and inner rotor, the inner rotor as well as the outer rotor may be mounted in fixed rotary bearings, provided the rotary bearings of the inner rotor have a correct axle distance or eccentricity measured relative to the central axis of the bearings of the outer rotor. Limiting to the extent of use of such early-described solutions has probably been that the outer rotor needs to be equipped with dynamic seals and rotary bearings, so which is avoided completely when a stator is used. On the other hand, an intermediate shaft and a universal joint may, in principle, be avoided when the stator is replaced with an outer rotor.

U.S. Pat. No. 5,407,337 describes a progressing cavity pump (termed a "helical gear fluid machine" herein), where an outer rotor has parallel bearings fixed in a pump casing, and where an external motor has a drive shaft extending through the external wall of the pump casing in a fixed position parallel to, but with an adapted spacing from, the centre axis of outer rotor. Through a flexible coupling, the drive shaft of the motor drives the inner rotor which, besides said coupling, does not have any other support than the walls of the helical cavity of the outer rotor, assuming that the material is an elastomer.

In U.S. Pat. No. 5,017,087 and also in WO99/22141, John Leisman Sneddon has described embodiments of progressing cavity pumps, where the outer rotor of the pump is enclosed by, and fixedly connected to, the rotor of an electromotor having stator windings fixedly connected to the pump casing. In these embodiments, both the outer and inner rotors of the pump are also fixedly supported in the same pump casing, whereby the outer and inner rotors of the pump together function as a mechanical gear driving the inner rotor at the correct speed relative to the outer rotor, which in turn is driven by said electromotor. These embodiments of progressing cavity pumps are also characterized in that the, in principle, closed pump cavities extend linearly through the pump from the inlet side of the pump to the outlet side of the pump, wherein the pump may be mounted directly between two flanges on a rectilinear pipeline and, in principle, independently of any further foundation. Such a linear arrangement will be of particular interest if the pump is mounted into a freely suspended, vertical underwater pipeline.

Such a linear embodiment also makes the pump particularly suitable for tackling so-called slugs or a fast-running plug is flow. Rather than to cause great mechanical strains and a particularly corrosive environment in a conventional inlet chamber, where the liquid flow enters perpendicularly to the flow axis of the pump, instead the velocity energy runs linearly through the pump and actually contributes to supply a usable additional torque to the rotors of the pump.

European patent application EP 1.418.336 A1 discloses a progressing cavity pump provided with a rotor and a stator, where the stator of the pump also functions as the stator of an electromotor, and where the rotor of the pump also functions as the rotor of the electromotor. Similar to J. L. Sneddon's patents, in principle this pump allows for installation of the pump directly into a linear pipeline. But in this case and all other cases in which the part with (Z+1) internal threads is a stator instead of an outer rotor, the mass centre of the inner rotor will be imparted a rotating motion, including resulting fluctuating radial forces and eccentricity in the pump. Moreover, the, in principle, closed pump cavities will not move rectilinearly from the inlet of the pump to the outlet of the pump, but they will follow a nearly helical pattern of movement.

The, in principle, closed pump cavities in active parts of a progressing cavity pump are generally defined by external and internal thread surfaces, and by the lines formed by real or approximate contact points between internal and external threads. In the following, these lines will be termed barriers, and a distinction will be made between longitudinal barriers and transverse barriers. All the cavities have two longitudinal, approximately helical barriers formed at least by approximate contact between the side surfaces of the threads, and also by two transverse barriers having internal thread-bottoms and external thread-crests meeting along a transverse curved line. In this connection, transverse implies that the curve of the barrier extends in a plane perpendicular to the longitudinal axes of the threads. When the pump is caused to rotate, longitudinal and transverse barriers in any such cavity are moved synchronously towards the outlet until the foremost transverse barrier, which is closest to the outlet side, disappears, and the cavity opens relatively fast towards the medium on the outlet side, thereby becoming an outlet cavity.

The pressure build-up through a conventional progressing cavity pump depends on the compression occurring in the, in principle, closed pump cavities when receiving, through leaky barriers, a leakage flow from the outlet side being larger than the leakage flow from said pump cavities further towards the inlet side. When the pump medium is a substantially incompressible liquid, only a very small leakage flow is required before such a pressure build-up occurs. Therefore, it is possible to combine high volumetric efficiency with a relatively smooth pressure build-up through the pump.

In contrast, when a conventional progressing cavity pump is used for pressure increase in more compressible media, it will tend to provide a pulsing pressure and flow on the outlet side, including resulting vibrations, noise, load peaks on rotary bearings and increased corrosion in the adjacent pipeline and pump. The reason for this is that the compressible medium in a, in principle, closed pump cavity of a fixed size does not receive enough leakage flow through the barriers to allow the pressure to increase to something close to the outlet pressure before the foremost transverse barrier disappears. Once the foremost barrier is opened, the compressible medium will expand on the outlet side and cause a powerful, instantaneous back-flow of considerable pump medium amounts into the new outlet cavity. Therefore, either an undesirably large leakage flow, hence limited volumetric efficiency, must be permitted, or the pump must be dimensioned to be able to withstand said vibrations and possibly seek to stabilize the flow downstream of the pump through the installation of pressure stabilizers in the form of accumulators, control valves or similar.

If the pump medium has a stable homogenous composition of fixed compressibility and the operating conditions provide for a stable differential pressure, it is nevertheless known to remedy said problem by forming the internal and external screws to be conical so as to allow the, in principle, restricted pump cavities to have reduced volumes towards the outlet side, whereby the pump will work as a compressor. This will be achievable provided the internal and external threads have mutually adapted conicities. However, such a conical shape of the eccentric screws will prove very unfortunate in applications where the fluid is of varying composition and, in periods, is approximately incompressible. During such periods, the medium will then tend to block the rotation of the pump.

The object of the invention is to remedy or reduce at least one of the disadvantages of the prior art.

The object is achieved by means of features disclosed in the following description and in the subsequent claims.

A progressing cavity pump in accordance with the invention is disclosed which is adapted for pumping of compressible fluids, wherein the progressing cavity pump has an inner rotor with a number of thread-starts, wherein the inner rotor cooperates with an adapted stator or outer rotor provided with one thread-start more than that of the internal rotor, and wherein a number of restricted pump cavities are formed which, during fluid transport, are moved from the inlet side of the pump to the outlet side of the pump, each pump cavity having a length corresponding to the pitch of the outer rotor, characterized in that at least one passage is disposed between the outlet side and the at least one pump cavity defined closest to the outlet side, wherein said passage is structured for intentional fluid back-flow from the outlet side in a measured and approximately constant volume so as to allow the pressure, under the assumed operating conditions, to be approximately equalized between the outlet side and said pump cavity before the pump cavity is fully opened towards the outlet side.

It is advantageous for the intentional back-flow to reach only the one pump cavity being closest to the outlet side so as to allow all of the other pump cavities to contribute in an unimpaired manner to the volumetric efficiency of the pump and the required pressure build-up. This is achieved by virtue of the disposed passage extending upstream in the axial direction only to a distance from the outlet of the active helical parts of the pump corresponding to the distance between two transverse barriers positioned closest to each other. This distance is generally SI/Z, Z being the number of thread-starts for the inner rotor, and SI being the shortest distance between 2 thread-crests belonging to the same thread-start on the inner rotor.

In an advantageous embodiment, the disposed passage is achieved by virtue of an increased clearance between the outer thread surface of the inner rotor and the inner thread surface of the outer rotor over the length SI/Z closest to the outlet of the screw. The clearance can be achieved either by virtue of reducing the cross-section of the inner rotor, or by virtue of expanding the cavity cross-section of the outer rotor, or by virtue of doing both at the same time to a matching extent.

The clearance between the inner rotor and the outer rotor may be expanded to a varying extent over the relevant length, which preferably is equal to or somewhat smaller than SI/Z, the length of which may also be longer than this should the pump have a considerable number of restricted cavities.

By allowing the one pump cavity located, at any time, closest to the outlet side of the pump to receive a substantially larger leakage flow than that of all the other pump cavities, whereby the differential pressure between the outlet side and this pump cavity is approximately equalized before suddenly opening fully towards the outlet side, the outlet pressure and the outlet flow are stabilized in spite of the compressibility of the liquid, and without substantially reducing the overall efficiency of the pump. It is then assumed that several pump cavities remain unaffected by the disposed passage.

By forming one pump cavity partially open, the back-flow will be distributed substantially more uniform over time, and the outlet pressure and also the net pump flow will pulsate at considerably reduced amplitudes relative to a conventional solution. Should more than one pump cavity be partially open having relatively large clearances, no improved pressure equalisation would be achieved owing to the fact that substantial pressure pulses arise only when a transverse barrier suddenly disappears at the outlet side. Already at a partial opening of only one, in principle, closed cavity, such a sudden opening of a transverse barrier will never ever occur owing to the fact that the one cavity having an impaired barrier always will be the correct one. Accordingly, the passage disposed in an area restricted in the manner described above will change the total capacity of the pump only insignificantly provided the pump has a considerable number of, in principle, closed cavities. By extending the pump by a length of SI/Z, at least the capacity will be fully recovered.

In a conventional eccentric screw comprising an elastomeric stator, the maximum differential pressure between two cavities will have a practical limitation at ca. six bars, or perhaps maximum ten bars. In order to withstand large differential pressures, the pump must then be very long and provided with many closed cavities, but the pressure pulses will be limited by the elasticity of the stator, which tends to open all barriers having a differential pressure above ca. six bars. In contrast, if the elastic stator is replaced by a metallic or ceramic stator or outer rotor, even a considerably shorter pump may be furnished with greater capacity. The need for flow equalisation, as described in the present patent application, will increase. In spite of the pump having to be "extended" so as to correspond to the length of the increased clearances, the pump may be made substantially shorter and more compact than that of hitherto known designs furnished with elastic stators, and particularly if the liquid phase in a possible multi-phase flow has a relatively high viscosity, or if the number of revolutions is increased and the stator is replaced by an outer rotor. Still, the invention is not limited to application in progressing cavity pumps with outer metallic rotors, but it may, as far as it goes, also be used in otherwise more conventional solutions with intermediate shafts and elastic stators. It is also conceivable, without departing from the scope of protection of the patent application, to use a metallic or ceramic material in a pump provided with a fixed stator.

If a progressing cavity pump provided with an inner and an outer rotor is used, where one rotor drives the other, for example as disclosed in U.S. Pat. No. 5,017,087 and 5,407,337, it might be desirable to maintain the possibility of having a driving contact between the screw vanes of the inner and the outer rotors, in principle over the entire length of the screw. Expanding the clearance between the thread-crest and thread-bottom may suffice in this case, whereby only the transverse barrier is impaired, or the clearance could be expanded only at the thread flank not being in driving contact.

There are several other ways of disposing measured-out passages for back-flow into the foremost pump cavity than those hitherto described. One example would be to form the inner rotor and/or the outer rotor, possibly the stator, with axial bores from the outlet side, and to open these bores towards the pump cavity at a distance being ≤s/Z from the outlet of the screw. In this case, it is also conceivable to build valves into the bores, which ensures, in a manner known per se, an approximately constant leakage flow independently of differential pressures between the outlet side and the partially open pump cavity.

It is also conceivable to form grooves in the rotor or the stator over a length of at least s/Z. For example, but not limited to, these grooves may be helical and placed on all thread-crests or thread-bottoms with the same pitch as the threads. They may then impair the foremost transverse barrier. By forming the grooves with an accurately measured-out and variable depth increasing towards the outlet, however, the grooves can be optimized in a manner allowing the pressure equalisation to become as effective as possible.

Even though it is an essential feature of the invention to be optimal to let only one pump cavity be formed partially open, and that it is considered documented that no better effect is achieved by partially opening, for example, two pump cavities, it will be within the scope of the invention to form the pump with two or more, in principle, partially open pump cavities in a pump where even this is an insignificant portion of the total number of pump cavities. This is what is to be understood by, for example, the statements "preferably equal to or smaller than SI/Z", and "preferably only the closest pump cavity".

The invention according to the application provides a progressing cavity pump for compressible media, for example multi-phase media, in which fluctuations in outlet pressure and outlet flow have been substantially reduced irrespective of the compressibility of the liquid, and approximately eliminated under the operating conditions most emphasized in the design basis. This is achieved without substantially reducing the total efficiency of the pump. Thereby, external supplementary installations for pressure equalisation may be avoided entirely or in part.

BREIF DESCRIPTION OF THE DRAWING

An example of a preferred embodiment is described in the following and is depicted in the accompanying drawings, where:

FIG. 1 schematically shows, in perspective, two pump parts of a prior art pump;

FIG. 2 schematically shows, in perspective, an inner rotor of the pump of FIG. 1;

DETAILED DESCRIPTION

Figure 1:
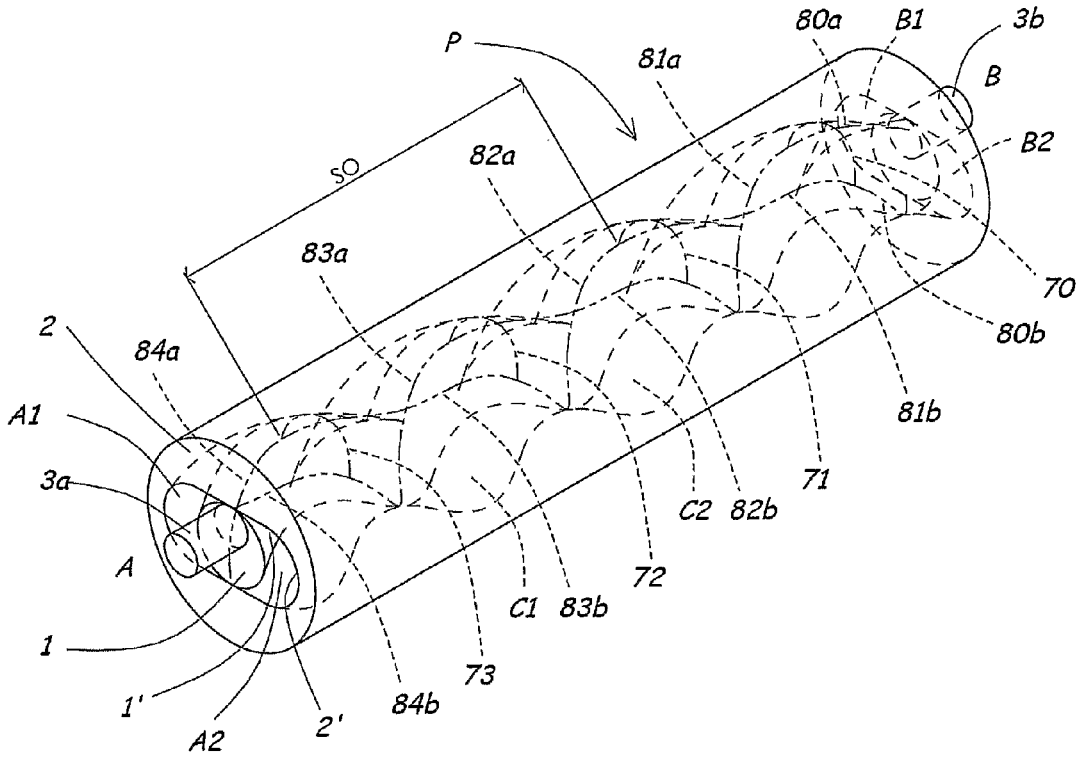

In the drawings, reference numeral P denotes the active components of a progressing cavity pump, comprising an inner rotor 1 and a stator or outer rotor 2. The number of thread-starts of the inner rotor is generally denoted by Z. Assuming compliance with what is known as Moineau's geometric principles in the trade, Z may be any positive integer. In all the examples of the figures, however, Z equals one.

Figure 4:
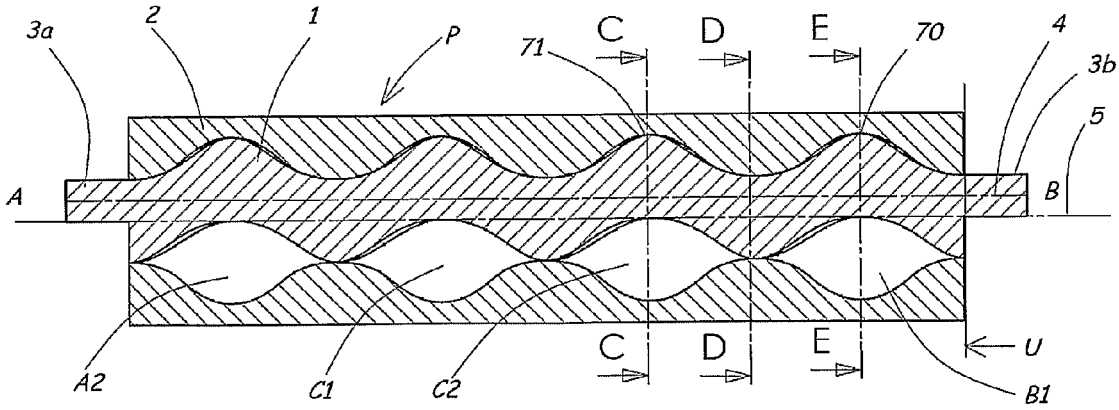
FIG. 4 shows a section A-A of FIG. 3.

In FIG. 1, the active components P of a prior art progressing cavity pump are shown in transparent view and highly simplified. In this embodiment, an outer stator or rotor 2 is provided with (Z+1)=2 thread-starts, whereas the inner rotor 1 is provided with Z=1 thread-starts. In FIG. 1, hidden lines are shown dotted. Shaft journals 3*a*, 3*b* for the inner rotor 1, the journals of which are concentric with the centre axis 4 of the external thread, see for example FIG. 4, are arranged parallel to, but at a fixed eccentric distance with respect to, the centre axis 5 of the outer rotor or stator 2. If the inner rotor 1 is mounted in a stator 2, the journal 3*a* typically is connected to the motor (not shown) of the pump by means of a universal joint (not shown) and an intermediate shaft (not shown). Approximate parallelism between the centre axis 4 of the rotor 1 and the centre axis 5 of the stator 2 is a natural consequence of the geometry of the outer thread 1' of the rotor 1 and the internal thread 2' of the stator 2, and a natural consequence of the relatively narrow fits between the rotor 1 and the stator 2.

Together the inner rotor 1 and the outer rotor or stator 2 define a number of, in principle, closed pump cavities C1, C2, and also a number (Z+1) of inlet cavities A1, A2, where the inlet cavities A1, A2 are open towards the inlet side A of the pump, and a number (A+1) of outlet cavities B1, B2 being completely open towards the outlet side B of the pump.

The, in principle, closed pump cavities C1 all have a length corresponding to the thread pitch SO of the outer rotor. The pump cavity C1 is defined by, for example, a fourth transverse barrier 73 and a second transverse barrier 71 and also longitudinal barrier portions 83*b*, 82*a* and 83*a*, 82*b*. The barriers, for example barriers 70, 71, 72, 73, and barrier portions 80*a*, 80*b*, 81*a*, 81*b*, 82*a*, 82*b*, 83*a*, 83*b*, 84*a* and 84*b* are shown in FIG. 1 with dash-double-dotted lines. As viewed from the cavity C1, the barrier portions 83*a* and 82 constitute one continuous longitudinal barrier, whereas the barrier portions 83*b* and 82*a* constitute the second of a total of two longitudinal barriers.

In the open cavity B2, the fluid pressure from the outlet side B of the pump P faces a transverse first barrier 70 and the longitudinal barrier portions 80*a* and 80*b*. The cavity B1 has a longer extent given that it extends to the second transverse barrier 71.

Figure 2:
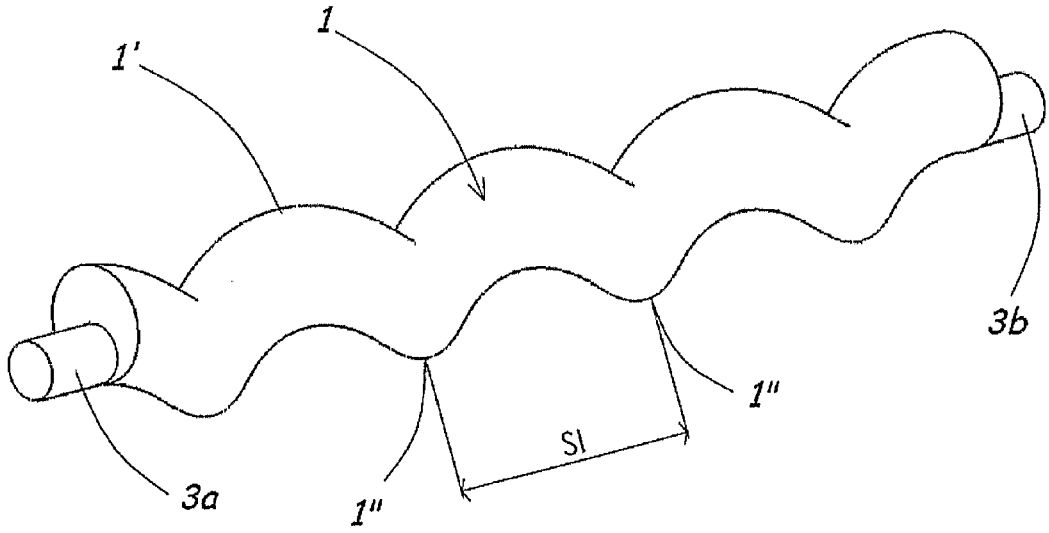

FIG. 2 more clearly shows the same inner rotor 1 as in FIG. 1, depicting from this case that the inner rotor 1 has the number of Z=1 thread-starts, and a length corresponding to four thread pitches SI for the external thread 1' of the rotor 1. Accordingly, the stator or the outer rotor 2 must have (Z+1)=2 thread-starts, as described above. The pitch SO of each thread-crest 1" is (Z+1)/Z=2 times the pitch of the inner rotor 1, and the stator or outer rotor 2 is to have the same effective length as that of the inner rotor 1.

Figure 3:
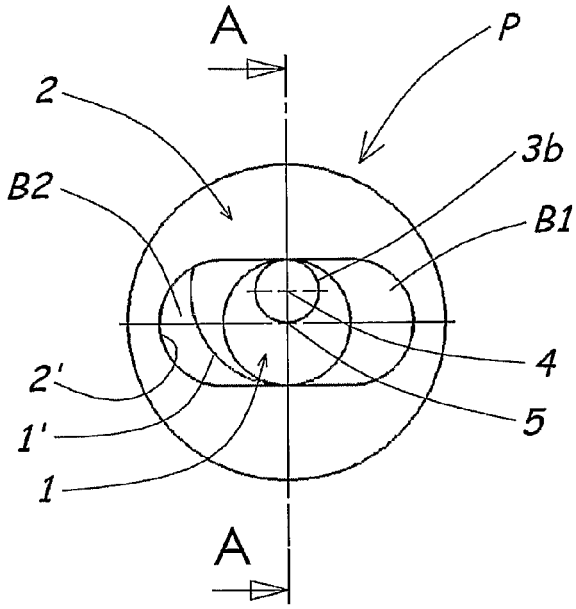
FIG. 3 shows an end view of the two pump parts of FIG. 1.

As viewed from the outlet side B, FIG. 3 shows the active components P of a conventional progressing cavity pump, including the inner rotor 1 and the stator or the outer rotor 2, where the inner rotor 1 is provided with a shaft journal 3*b*. The thread 1' of the inner rotor 1 has the centre axis 4, whereas the thread 2' of the outer rotor or stator 2 has the centre axis 5. Each of the open outlet cavities B1, B2 has one transverse barrier 71 and 70, respectively, see FIG. 1.

In FIG. 4, which shows the cross-section A-A of FIG. 3, several pump cavities C1, C2 are closed, in principle, whereas the inlet cavity A2 in front of the paper plane, see FIG. 1, is open towards the inlet side A by virtue of a transverse barrier towards the inlet side not being present. As mentioned, the outlet cavity B1 is open towards the outlet side B and is defined upstream by the second transverse barrier 71. The outlet cavity B2 is hidden behind the inner rotor 1, but it is defined upstream by the transverse barrier 70. The plane extending vertically from the thread axes and defining the active parts of the pump on the outlet side, the parts of which are defined as the portion formed with inner and outer threads in accordance with the Moineau principle, are generally to be denoted by U, see FIGS. 4, 8 and 12.

Figure 5:
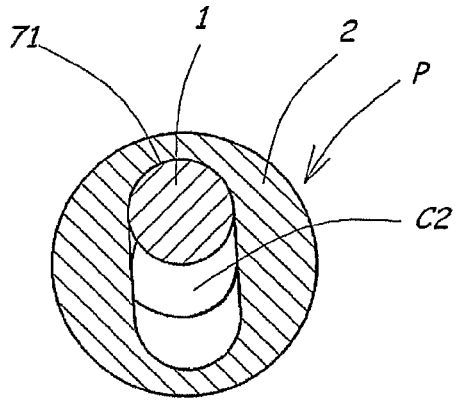
FIG. 5 shows a section B-B of FIG. 3.
Figure 6:
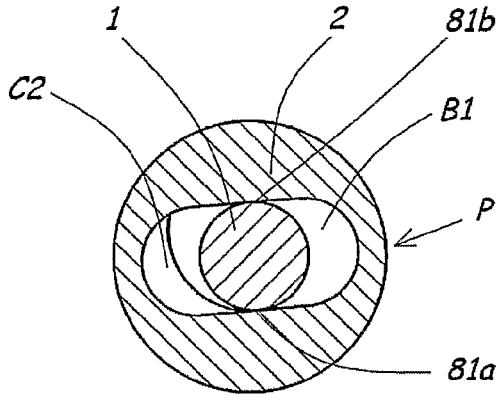
FIG. 6 shows a section D-D of FIG. 3.
Figure 7:
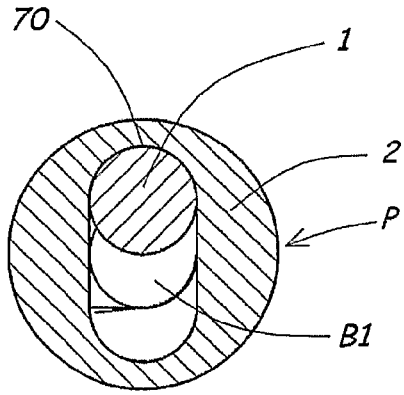
FIG. 7 shows a section E-E of FIG. 3.

FIGS. 5-7 show sections C, D and E depicted on FIG. 4. The denotations are the same as those in FIG. 1. For example, FIG. 6 illustrates the manner in which the longitudinal barrier portions 81*a* and 81*b* are formed and how they define a pump cavity C2 as well as an outlet cavity B1. Due to the barriers, the outlet cavity B1 may withstand a considerably higher fluid pressure than that of the pump cavity C2.

Hereinafter, a progressing cavity pump is described in more general terms, insofar as pumps of this type may be formed with several thread-starts. Even though the described exemplary embodiments are illustrated with progressing cavity pumps having the inner rotor 1 provided with one thread-start, the description is valid also for progressing cavity pumps having the inner rotor 1 provided with more than one thread-start, as shown per se in patents referred to in the prior art description.

In the following general part, some of the denotations differ from those used in FIGS. 1-7 for the purpose of acknowledging that a general application is involved herein.

Figure 8:
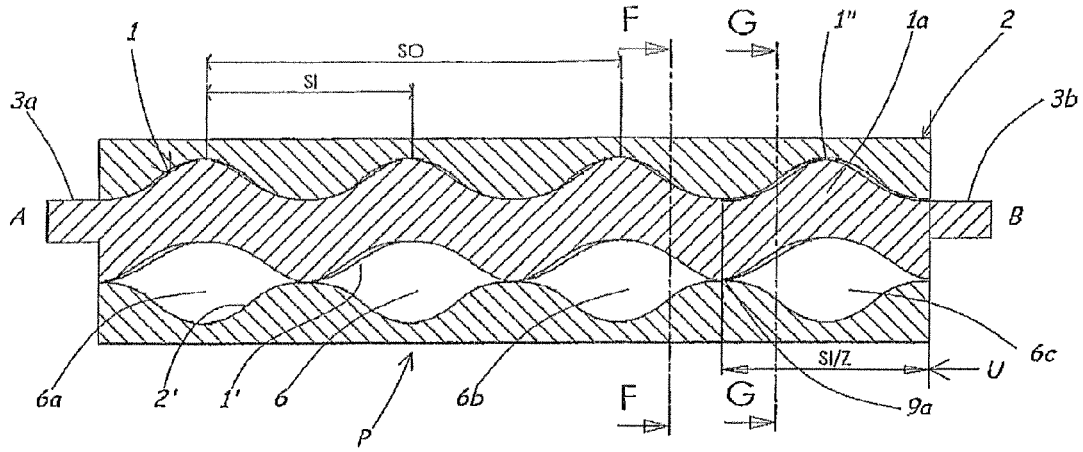
FIG. 8 shows an axial section of two pump parts according to the invention.

FIG. 8 shows a longitudinal cross-section of the active components P of a progressing cavity pump in accordance with the present invention. The inner rotor 1 is provided with a portion of reduced cross-section 1*a*, which here ideally extends downstream from position 9*a* at a distance SI/Z from the outlet U of the active pump portion. The, in principle, closed pump cavities are generally denoted by 6, whereas the inlet cavities are denoted by 6*a*. The pump cavities, which are formed in order to receive the intentional back-flow of liquid in measured amounts in accordance with the invention, are denoted by 6*b*, and the outlet cavities are denoted by 6*c*.

Figure 9:
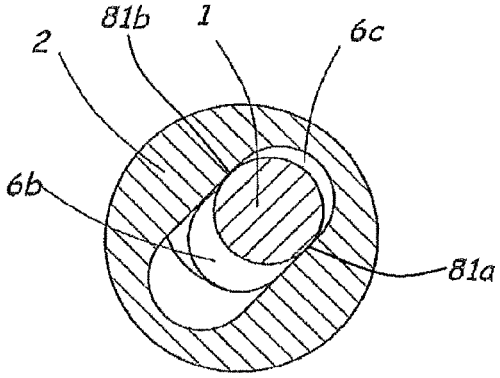
FIG. 9 shows a section F-F of FIG. 8.

FIG. 9 shows a cross-section F-F of FIG. 8, where the inner rotor 1 in principle has the same normal cross-section as that of corresponding, conventional progressing cavity pumps. Here, the longitudinal barrier portions 81*a* and 81*b* separate the outlet cavity 6*c* from the pump cavity 6*b* disposed for receiving intentional back-flow, but the adapted passages for the back-flow do not extend far enough upstream to reach this cross-section. Still, the pressure difference between the outlet cavity 6*c* and the pump cavity 6*b* will assume a lower value than the pressure difference between 6*b* and the closest, in principle, closed pump cavity 6.

Figure 10:
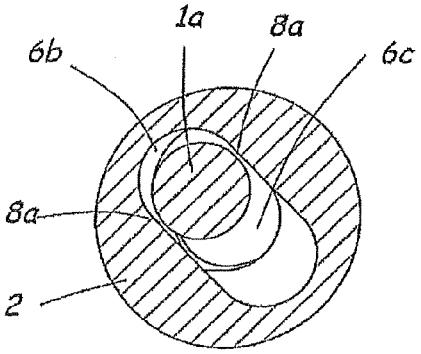
FIG. 10 shows a section G-G of FIG. 8.

FIG. 10 shows a cross-section G-G of FIG. 8 extending through the portion 1*a* of the inner rotor 1 having a reduced cross-section, where the longitudinal barriers denoted herein by 8*a* therefore have increased clearance adapted for the passing of measured amounts of back-flow from the outlet cavity 6*c* into the pump cavity 6*b*. Given that the reduced cross-section of FIG. 8 only extends over the length SI/Z, there will be only one cavity of the 6*b* type receiving intentional back-flow. This applies irrespective of the value of the integer Z.

Figure 11:
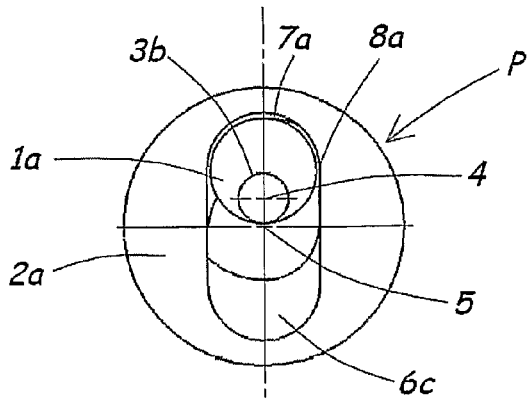
FIG. 11 shows, in an alternative embodiment, an end view of the two pump parts.

As viewed from the outlet side B, FIG. 11 shows the active components P of the same progressing cavity pump in accordance with the invention as that depicted in FIGS. 8-10, assuming that 2 is an outer rotor which, herein, has rotated 90° relative to the position in FIG. 8, and where the inner rotor has rotated (Z+1)/Z×90°=180°. The transverse, first barrier 7*a* closest to the outlet side B has reached the outer edge U of the active helical pump parts. Together with the longitudinal barriers 8*a*, the transverse barrier 7*a* act as passages for the intentional back-flow. While the inner rotor of the pump has rotated 180°, the length of the longitudinal barriers 8*a*, and hence the area of the disposed passages between the outlet chamber 6*c* and the pump chamber 6*b*, has increased gradually while, at the same time, the pressure difference has decreased, whereby the intentional back-flow has been approximately constant. In the position shown, immediately before the foremost barrier 7*a* disappears, the residual pressure difference between the outlet side B and the pump cavity 6*b* is assumed to be equalized sufficiently for a significant instantaneous back-flow impulse not to arise in the next moment.

Figure 12:
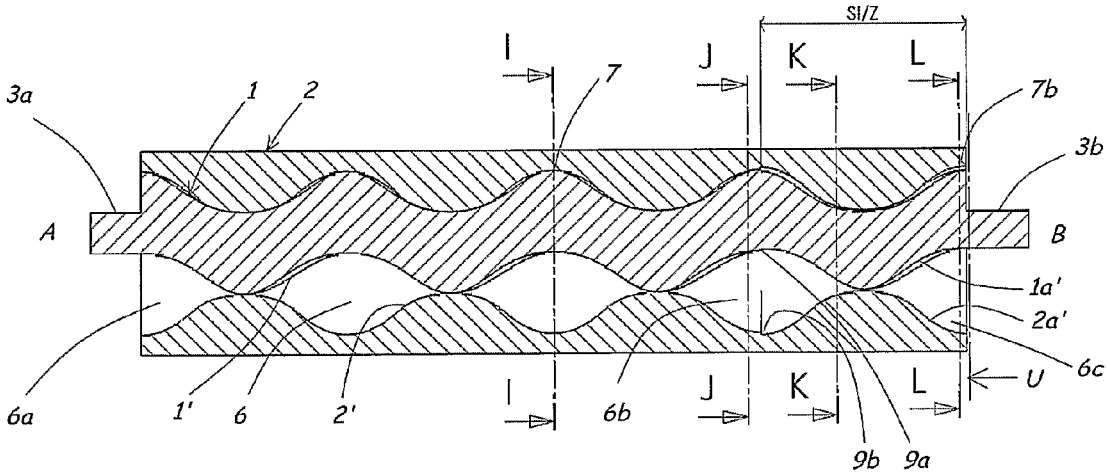
FIG. 12 shows a section H-H of FIG. 11.
Figure 13:
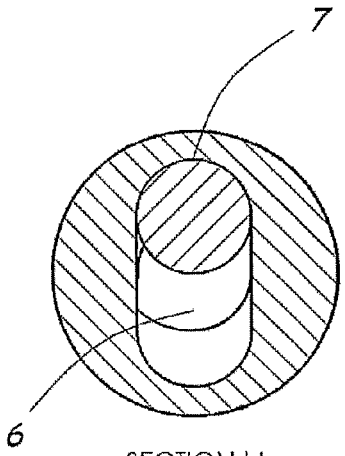
FIG. 13 shows a section I-I of FIG. 12.
Figure 14:
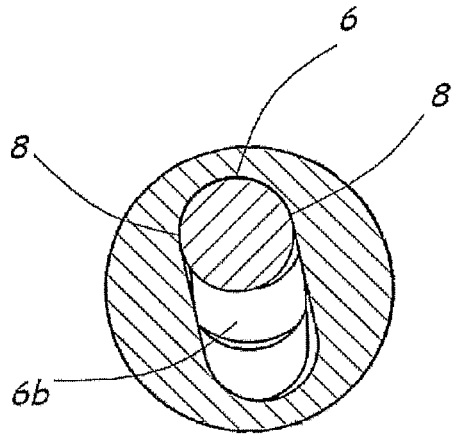
FIG. 14 shows a section J-J of FIG. 12.
Figure 15:
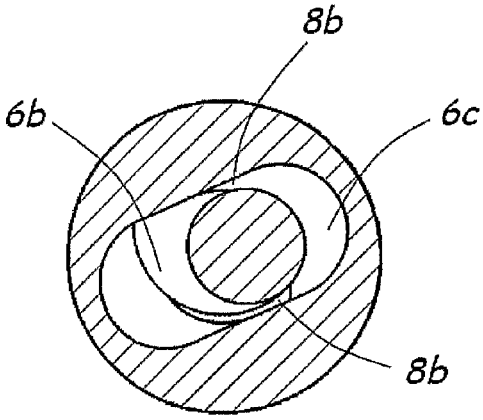
FIG. 15 shows a section K-K of FIG. 12.
Figure 16:
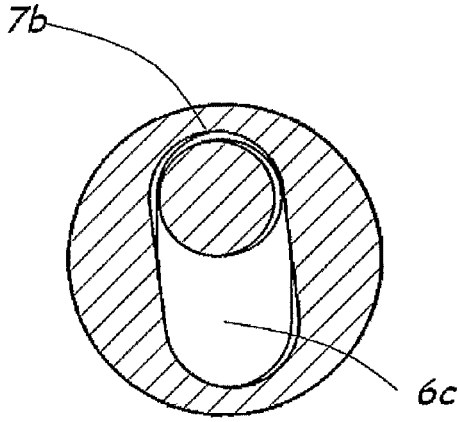
FIG. 16 shows a section L-L of FIG. 12.

FIG. 12 shows one axial section of another embodiment of a progressing cavity pump in accordance with the invention, where the internal thread 2' of the outer rotor 2 has been furnished with an expanded cross-section downstream in an area denoted by 2*a*' from a position 9*b*. At the same time, the external thread 1' of the inner rotor 1 has been furnished with a reduced cross-section in an area denoted by 1*a*' from approximately the same position 9*a* at a distance of about SI/Z from the outlet plane U of the active parts P of the pump.

FIGS. 13-16 show different sections of the pump of FIG. 12, in which the distribution between, in principle, closed pump cavities 6, pump cavities with intentional back-flow 6*b*, and open outlet cavities 6*c* are shown. In principle, closed barriers 7, 8, and barriers 7*b*, 8*b* with intentionally expanded clearance are illustrated at the same time.

The invention claimed is:

1. A progressing cavity pump adapted for pumping of a compressible fluid, comprising:

an inner rotor having a number of thread-starts; and an adapted outer rotor, wherein the adapted outer rotor is provided with one extra thread-start than the number of thread-starts of the inner rotor, wherein a number of closed pump cavities are formed which are moved, during fluid conveyance, from an inlet side of the pump to an outlet side of the pump such that, at the outlet side of the pump, the closed pump cavities become open outlet cavities exposed to a fluid pressure downstream of the pump, wherein at least one passage is disposed between the outlet side and a closed pump cavity closest to the outlet side, and wherein the at least one passage is structured for intentional fluid back-flow from the outlet side in a measured and approximately constant volume such that pressure is approximately equalized between the outlet side and the closed pump cavity closest to the outlet side under normal operating conditions before a foremost transverse barrier of the closed pump cavity closest to the outlet side reaches an outlet plane of a helical pump section and thereby disappears.

2. The progressing cavity pump according to claim 1, wherein a substantially expanded clearance is disposed in an area closest to the outlet plane of the helical pump section, wherein the clearance is located between the inner rotor and the adapted outer rotor, and wherein the area of substantially expanded clearance has an extent, in a counter-current axial direction, that is equal to or smaller than SI/Z, Z being the number of thread-starts for the inner rotor, and SI being a shortest distance between two thread-crests belonging to a same thread-start on the inner rotor.

3. The progressing cavity pump according to claim 2, wherein the clearance is located between the inner rotor and the outer rotor, and wherein the clearance between the inner rotor and outer rotor is expanded to a varying extent over a length, which is larger than or equal to SI/Z.

4. The progressing cavity pump in accordance with claim 2, wherein the substantially expanded clearance is achieved by virtue of a reduced cross-section of the inner rotor over length SI/Z closest to the outlet plane of the helical pump section.

5. The progressing cavity pump according to claim 1, wherein the adapted outer rotor has an expanded cavity cross-section over a length SI/Z closest to the outlet plane of the helical pump section, and wherein Z is the number of thread-starts for the inner rotor and SI is a shortest distance between two thread-crests belonging to a same thread-start on the inner rotor.

6. The progressing cavity pump according to claim 5, wherein the adapted outer rotor has internal threads, wherein the outer rotor and inner rotor are configured to be in driving contact with each other, and wherein expansion of the expanded cavity cross-section of the outer rotor is implemented only on internal thread-bottoms such that a driving contact is allowed between the inner rotor and outer rotor over an entire length of the inner and outer rotors.

7. The progressing cavity pump according to claim 1, wherein the at least one passage between the outlet side and the closed pump cavity closest to the outlet side comprises a groove or hole in at least the inner rotor and the adapted outer rotor.

8. The progressing cavity pump in accordance with claim 1, wherein the at least one passage is a helical groove following all thread-crests and/or thread-bottoms over a length which is approximately equal to SI/Z, wherein Z is the number of thread-starts for the inner rotor and SI is a shortest distance between two thread-crests belonging to a same thread-start on the inner rotor, and wherein the groove has an increasing cross-section towards the outlet side such that a first transverse barrier is increasingly impaired as differential pressure decreases towards the outlet side.

9. The progressing cavity pump according to claim 1, wherein achievable differential pressure across the entire pump is maintained at least by extending active helical parts of the pump by length SI/Z, wherein Z is the number of thread-starts for the inner rotor and SI is a shortest distance between two thread-crests belonging to a same thread-start on the inner rotor.

* * * * *